United States Patent [19]

Saito

[11] 4,301,241

[45] Nov. 17, 1981

[54] PROCESS FOR FORMING LIGHT-SENSITIVE SILVER HALIDE CRYSTALS

[75] Inventor: Mitsuo Saito, Minami-ashigara, Japan

[73] Assignee: Fuji Photo Film Co., Ltd., Minami-ashigara, Japan

[21] Appl. No.: 44,133

[22] Filed: May 31, 1979

[30] Foreign Application Priority Data

Apr. 23, 1979 [JP] Japan ..... 54-50704

[51] Int. Cl.[3] ..... G03C 1/02

[52] U.S. Cl. ..... 430/569; 430/567

[58] Field of Search ..... 96/94 R; 430/567, 569; 423/23, 38, 46; 23/295 R, 302 R, 305 R

[56] References Cited

U.S. PATENT DOCUMENTS

| | | | |
|---|---|---|---|
| 2,592,250 | 4/1952 | Davey et al. | 96/94 R X |
| 3,598,593 | 8/1971 | Klinger | 96/94 R |
| 3,650,757 | 3/1972 | Irie et al. | 96/94 R |
| 3,655,394 | 4/1972 | Illingsworth | 96/94 R X |
| 3,672,900 | 6/1972 | Korz | 430/567 |
| 3,773,516 | 11/1973 | Gutoff | 96/94 R |
| 3,821,002 | 6/1974 | Culhane et al. | 96/94 R |
| 3,885,970 | 5/1975 | Miyahara | 430/567 |
| 3,957,488 | 5/1976 | Klotzer et al. | 430/567 X |
| 4,063,951 | 12/1977 | Bogg | 430/567 |
| 4,067,739 | 1/1978 | Lewis | 430/567 |
| 4,080,210 | 3/1978 | Asada et al. | 430/569 X |
| 4,124,383 | 11/1978 | Denk | 96/94 R X |
| 4,147,551 | 4/1979 | Finnicum et al. | 96/94 R |
| 4,150,994 | 4/1979 | Maternaghan | 96/94 R |
| 4,153,462 | 5/1979 | Gerber et al. | 430/569 |

*Primary Examiner*—J. Travis Brown

*Attorney, Agent, or Firm*—Sughrue, Mion, Zinn, Macpeak and Seas

[57] ABSTRACT

A process for forming light-sensitive silver halide crystals by adding silver ion and halide ion in the presence of a protective colloid, which comprises producing seed crystals containing multiple twin crystal grains during a crystal nuclei-forming period, maintaining the pBr of the system at about 4.8 to 2.0 during at least the first third of the subsequent crystal-growing period, and increasing the rates of silver ion and halide ion addition to levels at which the crystal growth rate becomes about 30 to 100% of the critical crystal growth rate throughout said crystal-growing period..

5 Claims, 2 Drawing Figures

PROCESS FOR FORMING LIGHT-SENSITIVE SILVER HALIDE CRYSTALS

BACKGROUND OF THE INVENTION

1. Field of the Invention

This invention relates to a process for forming light-sensitive silver halide crystals and, more particularly, to a process for growing crystal grains of light-sensitive silver halide.

2. Description of the Prior Art

Most of the emulsions in presently commercially available high speed photographic films are polydisperse emulsions containing multiple twin crystal grains. A narrow grain size distribution of the grains often serves to improve many photographic properties. For example, graininess is improved, and the emulsion becomes contrasty. However, there have so far been no techniques to remarkably narrow the grain size distribution of multiple twin crystal grains. According to British Pat. No. 1,520,976, an emulsion containing multiple twin crystal grains having a mean grain size of 0.93 μm with a variation coefficient of 20% is prepared by forming grains containing 90 mol % or more silver iodide at the initial stage of the formation of precipitates. However, this process is restricted to the formation of twin crystal grains by initiating the grain formation with grains containing 90 mol % or more iodide, and the grain size distribution of the resulting grains is not said to be sufficiently narrow.

SUMMARY OF THE INVENTION

An object of the present invention is to provide a process for preparing a light-sensitive silver halide emulsion containing multiple twin crystal grains with a narrower grain size distribution without the limit of forming 90 mol % or more silver iodide in the initial stage of the formation of precipitates.

Another object of the present invention is to provide a process for preparing, a light-sensitive silver halide emulsion containing multiple twin crystal grains and having a desired grain size distribution in a comparatively short time.

A further object of the present invention is to provide a process for forming a high-speed light-sensitive silver halide emulsion having contrasty properties.

Other objects of the present invention will become more apparent from the following descriptions.

These objects of the present invention have been attained by preparing light-sensitive silver halide crystals by adding silver ion and halide ion in the presence of a protective colloid, which process comprises producing seed crystals containing 10% or more in number of multiple twin crystal grains during a crystal nuclei-forming period, maintaining the pBr of the system at about 4.8 to 2.0 during at least the first third of a subsequent crystal-growing period, and adjusting the rates of silver ion and halide ion addition to levels at which the crystal growth rate becomes 30 to 100% of the critical crystal growth rate throughout said crystal-growing period.

DETAILED DESCRIPTION OF THE INVENTION

In the present invention, the period from the initiation of the addition of silver ion and halide ion to the completion of the addition is defined as the "crystal-forming period". This crystal-forming period comprises a first period which extends from the initiation of the addition of silver ion and halide ion to the stage where new crystal nuclei are not substantially produced any more, and a subsequent second period wherein crystals grow with substantially no formation of new crystal nuclei. In the present invention, the first period is referred to as "crystal nuclei-forming period", and the second as "crystal growth period".

However, the term "crystal growth period" as used herein indicates the period wherein crystal grains are allowed to grow substantially by the addition of silver ion and halide ion, and excludes the period wherein the addition of silver ion and halide ion is stopped.

The characteristic aspects of the present invention reside in that speed crystals containing multiple twin crystal grains are produced in this crystal nuclei-forming period, and that the seed crystals are allowed to grow during the crystal growth period under such condition that the pBr is maintained at about 4.8 to 2.0 during at least the first third of the crystal growth period, while adjusting the rates of silver ion and halide ion addition to the levels at which the crystal growth rate becomes 30 to 100% of the critical crystal growth rate, throughout the crystal growth period. The term "critical crystal growth rate" is used herein as in Wey and Strong, *Photographic Science and Engineering*, 21, No. 1, 1977 p. 14 and is the growth rate at the maximum rate of silver ion and halide in addition which does not produce nucleation, i.e., the formation of new seed grains.

Figure 1:
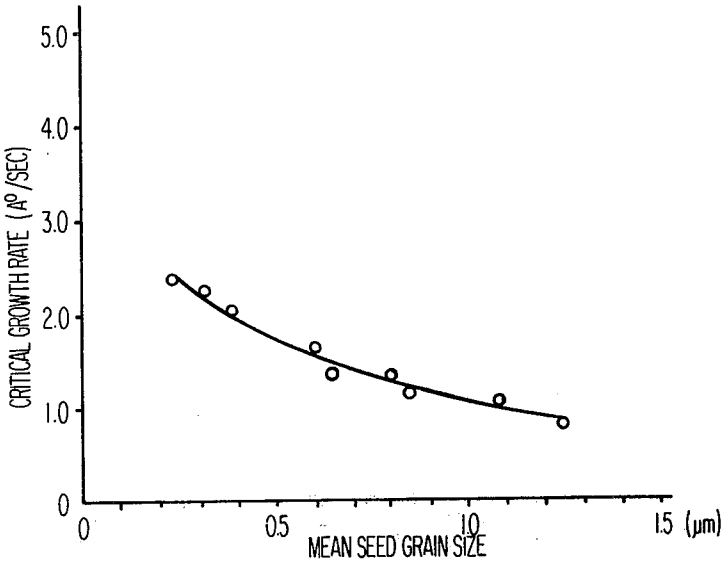
FIG. 1 is a graph of a typical relationship between the critical growth rate and the mean seed crystal grain size.

The silver ion and halide ion addition rates are determined in the following manner. First, the relationship between the seed grain size and the critical growth rate is experimentally determined by preparing seed grains having various grain sizes and gradually increasing the rate of silver ion and halide ion addition until the maximum rate of addition is reached at which the silver ion and halide ion supplied to the system are consumed by grain growth without the formation of new seed grains as defined above. A typical relationship between critical growth rate and mean seed grain size as shown in FIG. 1.

From the relationship between seed grain size and critical growth rate, the critical growth rate (dx/dt) can be represented as a function of grain size (x). That is:

$$dx/dt = F(x)$$

Figure 2:
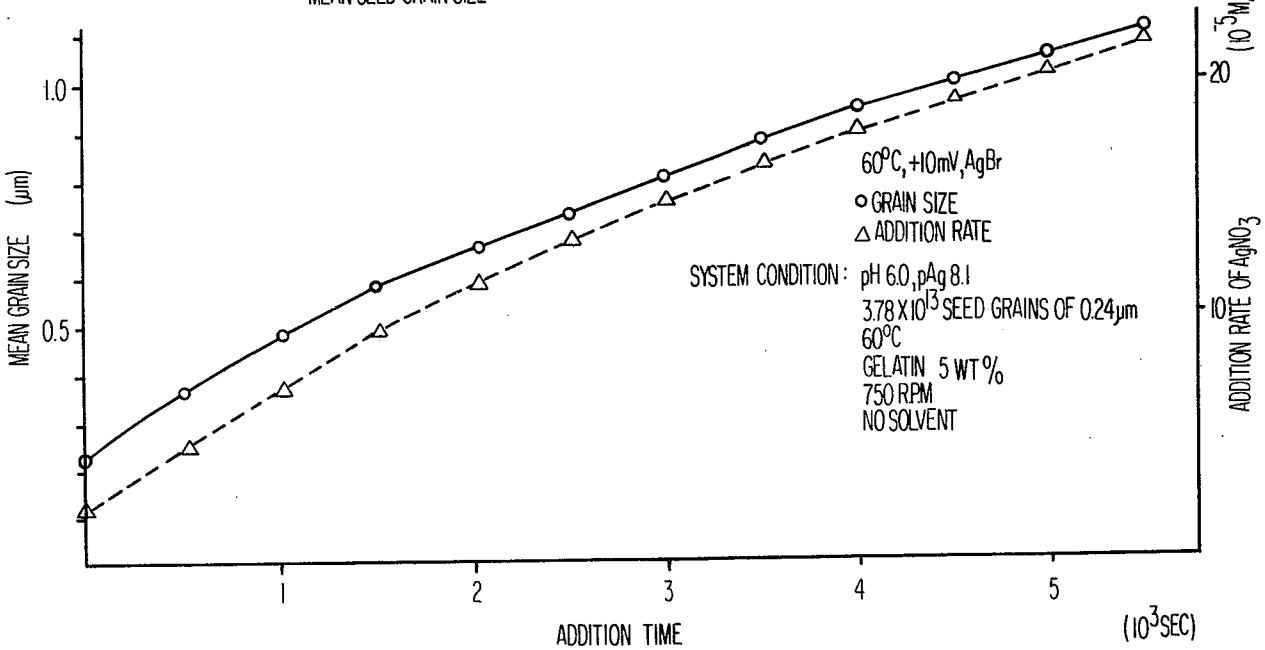
FIG. 2 is a relationship between mean grain size or addition rate of silver ion and addition time at a critical growth rate applicable to the present invention.

By integrating over time, grain size (x) can be represented as a function of time. Thus, a relationship between mean grain size and time of addition at the critical growth rate can be determined, i.e., x=G(t). Such a relationship is illustrated in FIG. 2.

Representing grain size (x) as a function of time, $$dx/dt = F(x) = F(G(t))$$

The addition rate (y) can be represented by the following equation:

$$y = k \cdot x^2 \cdot \frac{dx}{dt}$$

$$= k \cdot (G(t))^2 \cdot F(G(t))$$

-continued $= A(t)$

Thus, the addition rate (y) can be represented as a function of time at the critical growth rate as shown in FIG. 2.

Thus, in accordance with the present invention the rate of silver ion and halide ion addition is determined by first experimentally determining the relationship between critical growth rate and the mean seed grain size. From this relationship a relationship between the rate of addition of silver ion and halide ion and the addition time can be determined at the critical growth rate. When the rate of addition of silver ion and halide ion is increased in accordance with FIG. 2, for example, 100% of the critical growth rate is attained. In the case of growing crystals at 30% of the critical growth rate, the silver ion and halide ion are added at 30% of this rate. Since the rate of growth of a seed grain is quite small in comparison to the size of the seed grain, it can be assumed that 30% of the addition rate results in about 30% of the critical growth rate.

Silver ion and halide ion addition rates can be determined for a variety of conditions by first experimentally and individually determining the relationship between the critical growth rate and a condition such as gelatin concentration, pH, mixing seed, pAg, silver halide solvent concentration and silver halide composition and extrapolating the change in critical growth rate from the relative changes induced by a change in each of these conditions.

As is described above, the present invention is characterized in that growth of crystals is carried out while maintaining pBr at about 4.8 to 2.0 during the first third or more of the crystal-growing period. It is particularly preferable to maintain pBr at about 4.8 to 2.0 throughout the entire crystal-growing period. If the pBr is not maintained at 4.8 to 2.0 throughout the crystal-growing period, it is desirable to maintain the pBr at about 4.8 to 2.0 during at least the first third of the crystal-growing period, and at about 4.8 to 1.5 durng at least the first third of the remaining period.

As the seed crystals, those produced in the crystal nuclei-forming period upon initiation of the addition of silver ion and halide ion may be used as produced, or seed crystals previously prepared in another reaction vessel may also be used. The seed crystals in the present invention contain 10% or more in number of multiple twin crystal grains. The term "multiple twin crystal grains" as used herein indicates silver halide crystal grains having two or more twin crystal faces in one grain.

The size and size distribution of silver halide crystal grains to be used as seed crystals are not particularly limited but, in general, the size distribution is of a polydisperse system. The term "polydisperse" as used herein means a system with a variaton coefficient of 15–70%.

The form of multiple twin crystal grains is described in detail in E. Klein, et al; Die *Grundlagen Der Photographischen Prozesse Mit Silverhalogeniden,* Academische Verlagsgesellschaft Frankfurt Am Main (1968). Those skilled in the art can easily discriminate the multiple twin crystal grains through electron microscopic observation.

As to the method of adding silver ion and halide ion to be employed in the present invention, silver ion is usually added in the form of an aqueous solution of a water-soluble silver salt (for example, silver nitrate), and halide ion in the form of an aqueous solution of a water-soluble halide salt (for example, potassium bromide, sodium bromide, potassium chloride, potassium iodide, etc.); for example, in the case of preparing silver bromide crystals, a silver nitrate aqueous solution and a potassium bromide aqueous solution are used.

It is also possible to previously prepare super-fine silver halide grains with a grain size of not more than 0.10 μm and use the super-fine silver halide grains as the source for silver ion and halide ion.

In order to produce polydisperse seed crystals containing multiple twin crystal grains in the crystal nuclei-forming period, it is desirable to employ a halide concentration of 5 to $10^{-4}$ mol/liter in the reaction vessel, depending upon the temperature at a temperature of about 30° to 80° C. When the halide is chloride, halide concentrations of 50 mol % or less are suitable.

The period until formation of new crystal nuclei is substantially discontinued, that is the crystal nuclei-forming period, can be determined in practice by sampling the reaction vessel from time to time while forming silver halide crystals through addition of silver ion and halide ion to the reaction vessel and observing whether new nuclei are formed or not under an electron microscope. Alternatively, it is also possible to determine the crystal-growing period and the crystal nuclei-forming period by determining the mean grain size or diameter (L) for silver halide emulsions having been sampled from time to time during the reaction and plotting the relation between L and the amount of added silver (or halide) salt (V mols) on a graph to determine the period wherein the relation of $L \propto V^{\frac{1}{3}}$ holds. The period wherein the above-described relation holds is assumed to be the "crystal-growth period" and the period before it to be the "crystal nuclei-producing period".

The period wherein crystal nuclei containing multiple twin crystal grains grow is desirably not longer than $\frac{1}{3}$, particularly preferably not longer than 1/10, of the total crystal-forming period, i.e., the total period wherein the silver salt and the halide salt participating in the reaction are added to the system.

The volume of the grains finally obtained is about 5 to 500 times that of the seed crystals. It is described in C. R. Berry; *Photographic Science & Engineering,* 20, 1–4 (1976) that, in the formation of silver bromide crystals by adding a silver nitrate aqueous solution and a potassium bromide aqueous solution to a reaction vessel, extremely fine grains are constantly and temporarily formed, even during the crystal-growing period by the addition of the silver nitrate aqueous solution and the potassium bromide aqueous solution and function as an ion source for crystal grains to stably grow. Herein when it is said that, substantially no crystal nuclei are formed in the crystal-growing period means that there are substantially no newly formed crystal grains which stably grow and is not intended to exclude formation of such extremely fine grains.

In the present invention, the light-sensitive silver halide crystals are silver halide crystals used for photographic light-sensitive materials. The crystals can have a variety of compositions depending on end use. For example, there can be illustrated silver bromide, silver chlorobromoiodide containing not more than 50 mol % silver chloride, silver bromoiodide, silver chlorobromide containing not more than 50 mol % silver chloride, and the like.

As the protective colloid to be used in the present invention, gelatin is advantageous. In addition, hydrophilic polymers described in Japanese Patent Application (OPI) No. 68,133/75 can be used. Deionized gelatin may be used as well. The concentration of the hydrophilic colloid in the reaction vessel is preferably about 0.1 to 30 wt %.

As the method for increasing the rates of addition of silver ion and halide ion, the rate of addition of a given concentration of silver salt aqueous solution and a given concentration of halide salt aqueous solution may be increased, or the concentrations of the silver salt aqueous solution and the halide salt aqueous solution may be increased, as described in Japanese Patent Publication Nos. 36,890/73 and 16,364/77. Also, the rate of addition of a super-fine emulsion of not more than 0.10 μm in grain size previously prepared may be increased. These methods may be employed in combination. The rates of addition of the silver ion and halide ion may be increased intermittently or continuously.

How to increase the rates of addition of silver ion and halide ion depends upon the concentration of the copresent colloid, solubility of silver halide crystal grains, stirring rate in the reaction vessel, size and concentration of crystals existing at each stage, hydrogen ion concentration (pH of the aqueous solution in the reaction vessel), silver ion concentration (pAg), etc. and upon the final size of end crystal grains and the size distribution thereof. Conveniently, it can be determined through routine experiments.

The upper limit on the rates of addition of silver ion and halide ion may be set at a level which is slightly lower than that at which new crystal nuclei would be produced. The upper limits may be determined in a practical system by actually forming crystals employing various rates of addition of silver ion and halide ion, and microscopically observing samples sampled from the reaction vessel to confirm whether new crystal nuclei are formed or not.

The crystal growth rate at the upper limits is called critical crystal growth rate. [See, J. S. Wey and R. W. Strong; *Photographic Science and Engineering,* 21, 14 (1977).]

"Substantially no formation of new crystal nuclei" in the present invention means that the weight of newly formed crystal nuclei is not more than 20%, preferably not more than 5%, based on the weight of originally existing crystals.

The present invention is characterized in that pBr is maintained at about 4.8 to 2.0, particularly preferably about 3.8 to 2.3, during the first ⅓ or more of the crystal-growing period. If the pBr is lower than 2.0, multiple twin crystal grains selectively grow, which results in a wide grain size distribution of the resultant silver halide. On the other hand, if the pBr is higher than 4.8, photographic properties (sensitivity and fog) of the resulting emulsion suffer detrimental influences. Thus, such pBr values are not favorable.

In the case of increasing the rates of addition of silver ion and halide ion with forming substantially no new crystal nuclei, the crystal size can be increased by stirring the system in the reaction vessel under better conditions. That is, the critical growth rate can be increased, and the probability of forming new crystal nuclei can be reduced.

As the stirring method, a method using a mixing chamber immersed in the colloid as described in West German OLS No. 2,556,885 may be employed. Also, a method of adding into liquid as described in U.S. Pat. No. 3,415,650 may be employed. In addition, various baffles or stirring blades may be employed.

The present invention enables to change the pH value in the reaction vessel over a wide range, since grains can be made large without using a silver halide solvent, which is one merit of the present invention. The pH may be optionally selected between 1 to 11 depending upon the end purposes.

The preferable crystal concentration (number of crystal grains existing per 1 liter) is about $1\times10^{10}$ to $1\times10^{18}$ crystals/l. The higher the crystal concentration, the greater the critical growth rate and hence a crystal concentration of $1\times10^{12}$ crystals/l or more preferable. Where the total amounts of silver ion and halide ion added are definite, there is an upper limit on the crystal concentration because the grain size increases as the number of the grains is fewer. Thus, particularly preferable crystal concentration is $1\times10^{12}-1\times10^{17}$ crystals/l.

In the case of using gelatin as the protective colloid, a preferable gelatin concentration is about 0.1 to 30 wt %. However, the critical growth rate becomes slower as the gelatin concentration becomes less than 2 wt %. Therefore, a particularly preferable gelatin concentration is about 2 to 20 wt %.

In the formation of light-sensitive silver halide crystals according to the present invention, the combined use of a silver halide solvent raises the critical growth rate which enables the formation of crystals with a larger size. As the solvent, there can be used, for example, ammonia, thiocyanates, thioether compounds as described in W. German Patent Applicaton (OLS) No. 2,824,082, and silver halide solvents described in W. German Patent Application (OLS) No. 2,822,320 and Research Disclosure No. 16516 ('78, I).

In addtion, in preparing light-sensitive silver halide emulsion by the present invention, descriptions given in, for example, *Journal of Product Licensing* Index, 92, 107–110 (Dec. 1971) can be referred to as to the type of emulsion, washing of emulsion with water, chemical sensitization, antifogging agents, stabilizers, hardeners, vehicles, antistatic agents, coating aids, spectrally sensitizing agents, dyes, color couplers, etc.

The present invention will now be described in more detail by the following examples which, however, are not limitative at all.

Example 1

1,200 ml of water, 6.5 g of KBr, 3.5 g of KI, and 25 g of gelatin were added to a 4-l volume reaction vessel and while maintaining the temperature at 60° C., 1.5 ml of concentrated nitric acid was added thereto. To this solution was added an aqueous solution containing 70 g of KBr and 4 g of KI at a rate of 35 ml/minute. 30 seconds after the initiation of the addition, a 0.45 M solution of $AgNo_3$ was added thereto at a rate of 65 ml/minute. Each addition was continued for 20 minutes. After the completion of the addition, the mixture was ripened for 20 minutes. Then, a gelatin coagulant was added to flocculate the emulsion. After washing with water and re-dispersing the system, there was obtained 850 ml of emulsion. This emulsion contained multiple twin crystal grains, single twin crystal grains, and octahedral grains, with the ratio in number of the multiple twin crystal grains being about 32%, and the mean grain size being 0.42 μm with a variation coefficient of 29%.

50 ml of the above emulsion was sampled, and added as seed crystals to a 4-liter reaction vessel containing 900 ml of water and 50 g of gelatin. After adjusting the pH and the pBr to 7 and 2.7, respectively, a silver nitrate aqueous solution and a KBr aqueous solution were added thereto according to a controlled double jet method while controlling the pBr at 2.7. The addition was conducted as follows. $AgNO_3$ aqueous solutions and KBr aqueous solutions with concentrations of 1/6 M, $\frac{1}{4}$ M, $\frac{1}{3}$ M. $\frac{1}{2}$ M, and 0.65 M were added respectively in this order at a rate of 10 ml/minute in an amount of 240 ml. The crystal growth rate in this crystal-growing period was 50 to 85% of the critical growth rate. The thus obtained silver halide emulsion grains had a mean grain size of 0.86 μm with a variation coefficient of 13.4%. This was an extremely uniform size-distribution for an emulsion containing multiple twin crystal grains, and the emulsion provided higher contrast than an emulsion obtained in a conventional manner.

Example 2

50 ml of the seed crystal emulsion obtained in Example 1 was sampled and used as seed crystals. 900 ml of water, 50 g of gelatin, and 10 ml of a 50% $NH_4NO_3$ solution were added to a 4-liter reaction vessel and, after adjusting the mixture to 6 in pH and 2.7 in pBr, 1 ml of a 25% $NH_3$ solution was added 15 seconds before the initiation of the addition of $AgNO_3$. Then, $AgNO_3$ aqueous solutions and KBr aqueous solutions with concentrations of $\frac{1}{4}$ M, $\frac{1}{2}$ M, 0.65 M, and 1 M were added in an amount of 240 ml in this order at a rate of 10 ml/minute while maintaining the pBr at 2.7. The crystal growth rate in this crystal-growing period was 35 to 85% of the critical growth rate.

The thus obtained silver halide emulsion had a mean grain size of 0.96 μm with a variation coefficient of 11.6%, which was an extremely uniform size-distribution for an emulsion containing multiple twin crystal grains.

Example 3

50 ml of the seed crystal emulsion obtained in Example 1 was sampled and used as seed crystals. 900 ml of water, 50 g of gelatin, and 10 ml of a 50% $NH_4NO_3$ solution were added to a 4-liter reaction vessel and, after adjusting the mixture to 6 in pH and 2.7 in pBr, 1 ml of a 25% $NH_3$ solution was added thereto 15 seconds before the initiation of the addition of $AgNO_3$. Then, $AgNO_3$ aqueous solutions and KBr aqueous solutions with concentrations of $\frac{1}{4}$ M and $\frac{1}{2}$ M were added in an amount of 240 ml at a rate of 10 ml/minute while maintaining the pBr at 2.7. Then, $NH_3$ was neutralized with nitric acid to adjust the pH to 6 and, while maintaining pBr at 1.74, $AgNO_3$ aqueous solutions and KBr aqueous solutions with concentrations of 0.65 M and 1 M were added thereto in this order at a rate of 10 ml/minute in an amount of 240 ml. The crystal growth rate in this crystal-growing period was 35 to 85% of the critical growth rate.

The thus obtained emulsion grains had a mean grain size of 1.023 μm with a variation coefficient of 13.6%.

While the invention has been described in detail and with reference to specific embodiments thereof, it will be apparent to one skilled in the art that various changes and modifications can be made therein without departing from the spirit and scope thereof.

What is claimed is:

1. A process for forming light-sensitive silver halide crystals by adding silver ion in the form of a silver salt aqueous solution and halide ion in the form of a halide salt aqueous solution to a solution containing bromide ion in the presence of a protective colloid, which comprises producing seed crystals containing multiple twin crystal grains during a crystal nuclei-forming period, maintaining the pBr of the system at about 4.8 to 2.0 during at least the first third of a subsequent crystal-growing period, and increasing the rates of silver ion and halide ion addition to levels at which the crystal growth becomes about 30 to 100% of the critical crystal growth rate, including gradually increasing the concentration of said silver salt aqueous solution and said halide salt aqueous solution during said crystal-growing period.

2. The process of claim 1, wherein said seed crystal-growing period is not more than about 1/10 of said crystal-forming period.

3. The process of claim 1, wherein said silver salt aqueous solution and said halide salt aqueous solution are added such that the pBr in the reaction vessel is about 4.8 to 2.0 at the initiation of said crystal-growing period, and maintaining the pBr at said level during at least the first third of the crystal-growing period and at about 4.8 to 1.5 during at least the first third, of the remaining period.

4. The process of claim 1, wherein said seed crystals contain 10% or more in number of said multiple twin crystal grains.

5. The process of claim 1, wherein the process comprises producing said seed crystals containing multiple twin crystal grains by merely mixing said solutions.

* * * * *